United States Patent [19]

Dewaal

[11] Patent Number: 5,073,993

[45] Date of Patent: Dec. 24, 1991

[54] TOILET BOWL DISPENSER HANGER

[76] Inventor: Peter K. Dewaal, 4013 W. Burbank Blvd., Burbank, Calif. 91505

[21] Appl. No.: 552,585

[22] Filed: Jul. 12, 1990

[51] Int. Cl.[5] ..... E03D 9/02

[52] U.S. Cl. ..... 4/227; 4/228

[58] Field of Search ..... 4/227, 228, 231; 248/214, 215, 225.2, 303, 304, 307, 308, 311.2, 322, 339, 340, 544; 99/411, 413; 30/324, 325, 327

[56] References Cited

U.S. PATENT DOCUMENTS

| | | | |
|---|---|---|---|
| 1,566,982 | 12/1925 | Shee | 248/214 |
| 1,569,544 | 1/1926 | Jamison | 99/413 |
| 1,712,161 | 5/1929 | Olson | 99/413 X |
| 1,836,014 | 12/1931 | Chamberlain | 30/327 |
| 2,065,181 | 12/1936 | French | 4/227 |
| 2,098,294 | 11/1937 | Keillor | 4/228 |
| 2,291,981 | 8/1942 | Neururer | 30/324 |
| 2,920,853 | 1/1960 | Bufogle | 248/214 |
| 3,023,426 | 3/1962 | Neal | 4/228 |
| 3,093,835 | 6/1963 | Kaplan | 4/228 |
| 3,423,182 | 1/1969 | Klasky | 23/267 |
| 3,521,306 | 7/1970 | Jacobs | 4/228 |
| 3,943,582 | 3/1976 | Daeninckx et al. | 4/227 |
| 3,980,264 | 9/1976 | Tomasik | 248/311.2 X |
| 4,247,070 | 1/1981 | Dirksing | 248/226.5 |
| 4,370,763 | 2/1983 | Dolan | 4/228 |
| 4,455,692 | 6/1984 | Hegge et al. | 4/228 |
| 4,707,866 | 11/1987 | von Philipp et al. | 4/228 |
| 4,709,424 | 12/1987 | Dolan | 4/228 |

FOREIGN PATENT DOCUMENTS

| | | | |
|---|---|---|---|
| 639408 | 6/1928 | France | 99/411 |
| 80640 | 2/1958 | Netherlands | 30/325 |
| 5514 | of 1903 | United Kingdom | 4/228 |
| 3247 | of 1912 | United Kingdom | 30/325 |
| 916652 | 1/1963 | United Kingdom | 4/228 |

*Primary Examiner*—Henry J. Recla
*Assistant Examiner*—Robert M. Fetsuga
*Attorney, Agent, or Firm*—Michael J. Ram

[57] ABSTRACT

A hanger for holding a chemical dispenser within the tank of a toilet bowl comprises a bracket adjustable in length, a dispenser holder, hooks for mounting the hanger during both use and exchange of the dispenser, and a lifting mechanism to allow the hanger to be raised without soiling or wetting the user's hands.

8 Claims, 2 Drawing Sheets

TOILET BOWL DISPENSER HANGER

BACKGROUND

The present invention relates to an adjustable hanger for holding a dispenser for an additive for dispersion into a toilet bowl.

It is often desirable to treat the water in a toilet to prevent the toilet bowl from becoming stained, discolored or otherwise unsightly. To do this, it is well-known to provide chemical dispensers for placement in toilet tanks. These chemicals are intended to color, disinfect, treat and/or deodorize the water in the toilet bowl when the flushing mechanism is activated. The dispensers are either immersed in the tank by placement internally on the bottom thereof or mounted, through use of a hanger, to an internal wall of the tank.

The present invention is directed to hangers for use with dispensers usually placed on the bottom of the tank. Several patents show unitary hanger/holder construction. (U.S. Pat. Nos. 2,065,181; 2,098,294; 3,023,426; 3,423,182; 3,943,582; 4,247,070) while others disclose mechanisms which allow for adjustment of the placement level of the dispenser (U.S. Pat. Nos. 3,093,835; 4,455,692). However, none of these products have features which make removal and reloading of the dispenser convenient and which aid in preventing spillage of material from the new dispenser or water from the empty dispenser when the dispenser is replenished. Since commercially available chemical dispensers are usually placed on the bottom of the toilet tank, the user is unable to change the dispenser without wetting and soiling his hands. Therefore there is a real need for a holder which allows the replacement of a depleted chemical dispenser without wetting or soiling the user's hands or dirtying the area around the toilet during the exchange process.

SUMMARY

The present invention is directed to a hanger and dispenser holder that supplies this need and eliminates the deficiencies of the previous devices. The hanger comprises an elongated support which is mounted in the toilet tank. Located on the upper portion of the support is means, preferably a hook, for suspending the hanger from the toilet tank's side. Located in the lower portion of the support is means for holding an additive dispenser. Also, attached to the lower portion of the support is means, preferably a hook, for mounting the support on the toilet tank wall during exchange of a used chemical dispenser with a replacement dispenser.

The components of the hanger are located in relationship to each other so that the chemical dispenser is below the water level in the toilet tank when the suspending means is attached to the toilet tank at a point above the water level. The mounting means on the lower portion of the support is located so that the dispenser holder is positioned above the water level in the tank for exchange of dispensers when the support is mounted on the upper portion of the tank wall utilizing this lower mounting means.

The hanger can also include gripping means projecting from the upper portion of the support. The gripping means is located so that it can be grasped by the user and used to lift the dispenser out of the water in the toilet tank without the user's hands becoming wet or soiled.

The support is preferably composed of at least two pieces which are movable in regard to each other so that the length of the hanger can be adjusted for various tank sizes and water depths.

The dispenser holder typically is tubular in shape and sized to hold commercially available chemical dispensers which are available in short cylindrical bottles. Dispersion of the chemicals can be aided by fabricating the dispenser holder with openings and channels through which the water and chemicals can circulate.

DRAWINGS

These and other features, aspects, and advantages of the present invention will become better understood from the following description, appended claims, and accompanying drawings where:

DESCRIPTION

Figure 1:
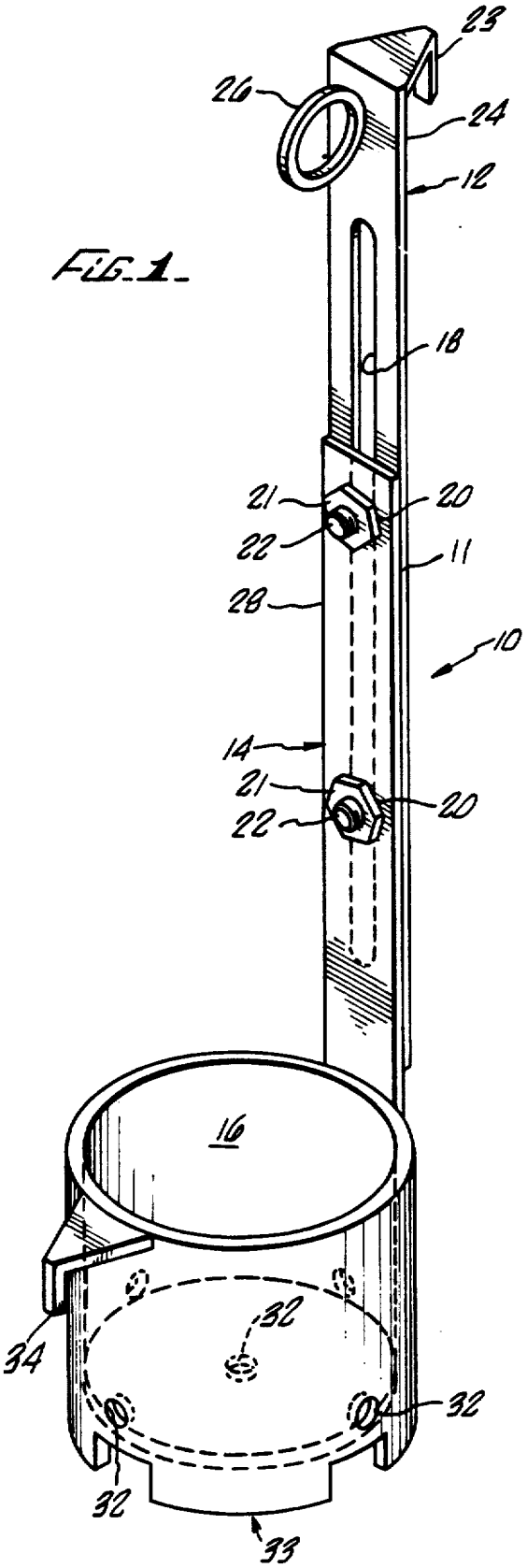
FIG. 1 is a perspective view of a hanger embodying features of the present invention.
Figure 2:
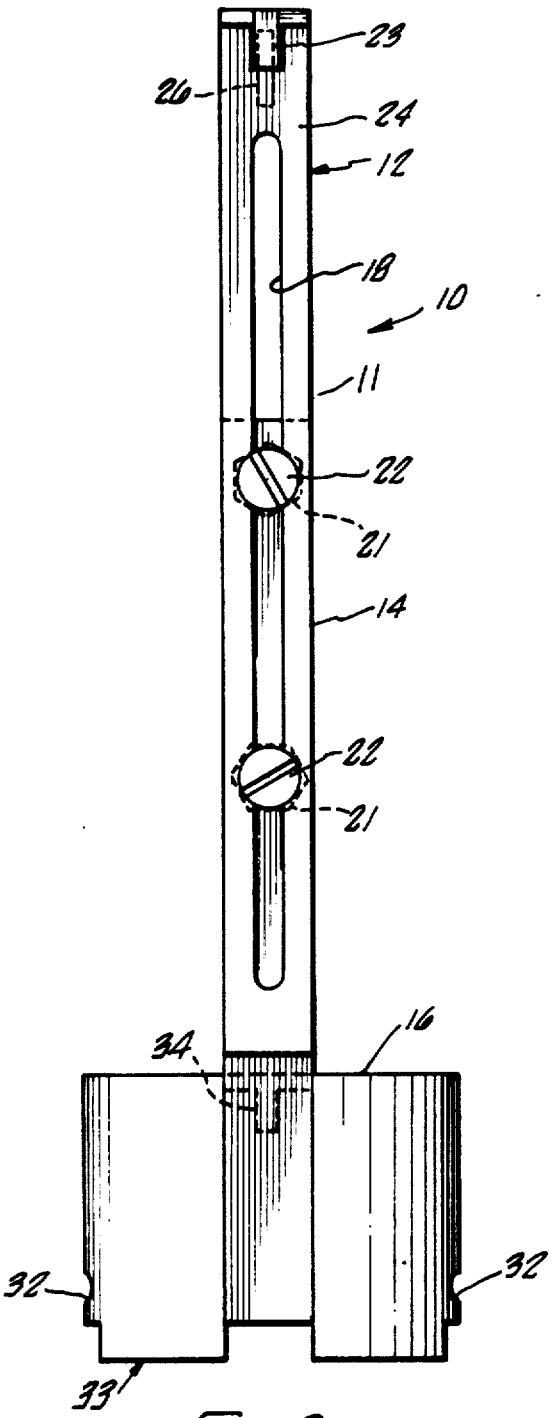
FIG. 2 is a rear elevation view of the hanger of FIG. 1.

FIGS. 1 and 2 show a preferred version of a hanger 10 according to the present invention. The hanger 10 comprises an elongated support 11 which preferably is formed in two pieces, an upper portion 12 and a lower portion 14. Attached to the lower portion 14 of the support 11 is a dispenser holder 16. The upper portion 12 of the support has a slot 18 along a major portion of its length to allow adjustment of the relative lengths of the upper and lower portions 12 and 14. The lower portion 14 has two holes 20 therein which can be aligned with the slot 18. In the preferred embodiment a nut 21 and bolt 22 arrangement is utilized to adjust and then lock the portions together when the desired length is obtained. However, the invention contemplates various arrangements of holes, slots and affixing means or other adjustable mechanisms such as ratchets, interlocking grooves, telescoping tubes or clamps.

The top end of the upper portion 12 has a hook 23 integral with the rear surface 24 and a loop 26 integral with the front surface 28. The hook 23 is designed to allow the hanger to be stably mounted to an internal top edge 38 of a toilet tank 40. The loop 26 is sized so that a finger can be placed therein so that the hanger can be lifted up to remove the chemical dispenser from the water in the tank.

The holder 16 is sized to accommodate commercially available toilet chemical dispensers 30 of the type usually placed on the bottom of the toilet tank. To allow better dispersion of the chemicals from the dispenser 30 drainage holes 32 can be incorporated in the walls and bottom of the holder 16. The bottom of the holder 16 can also incorporate a flange 33 to allow circulation under and around the base of the holder 16. In the embodiment of the figures, the holder 16 is a cylindrical cup. The holder 16 can be of any shape; however, tubular structure is preferred as commercially available dispensers are usually tubular containers.

Integral with the front of the holder 16 is an exchange hook 34 for use in temporary mounting of the hanger 10 during disposal of a depleted dispenser and replacement by a new unit.

Figure 3:
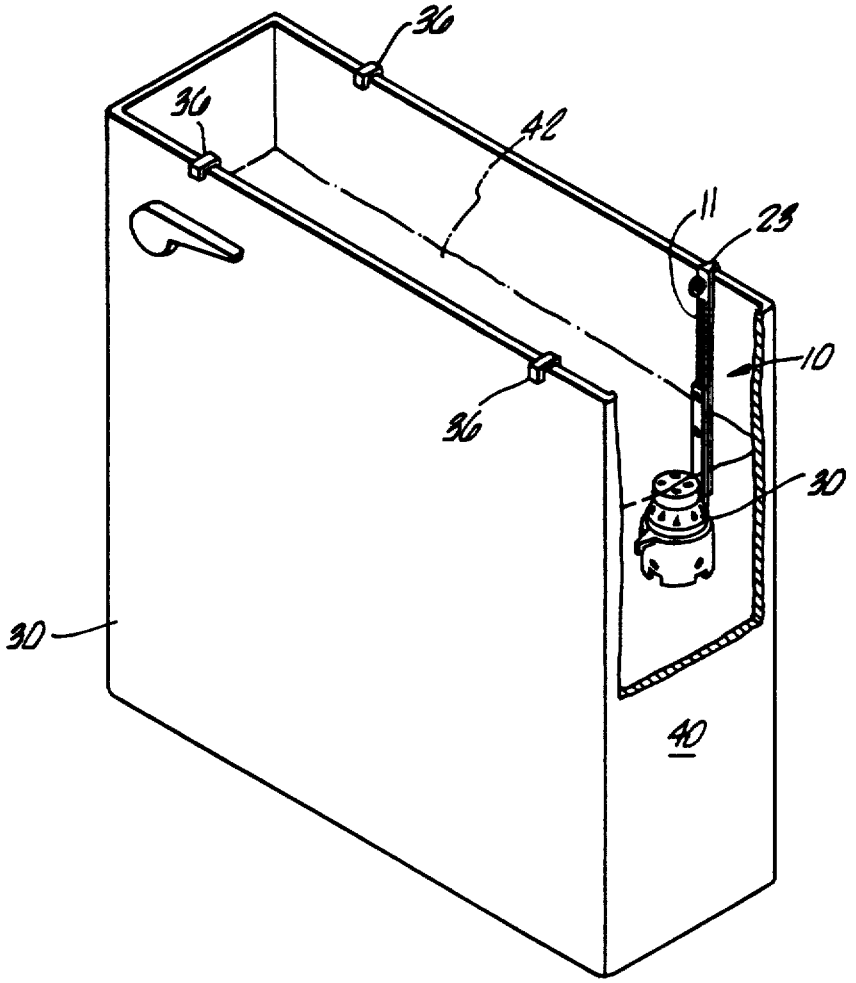
FIG. 3 is a perspective view of the hanger of FIG. 1 mounted in a toilet tank as it appears during normal use, the toilet tank being shown in a cut away view.

FIG. 3 shows the hanger 10 in its normal placement for use. The hook 23 allows the unit to be hung from anywhere along the top edge 38 of the toilet tank, preferably in a location which does not interfere with the flushing mechanism in the tank. A common problem with bottom mounted dispensers of other hangers is that they are too large or cannot be positioned in a location which does not interfere with the float valve or the drain cover. Also, shown are spacers 36 which are of the same thickness as hook 23. The use of the spacers 36 is desired so that the tank top is level on the tank after mounting of the hanger 10.

Figure 4:
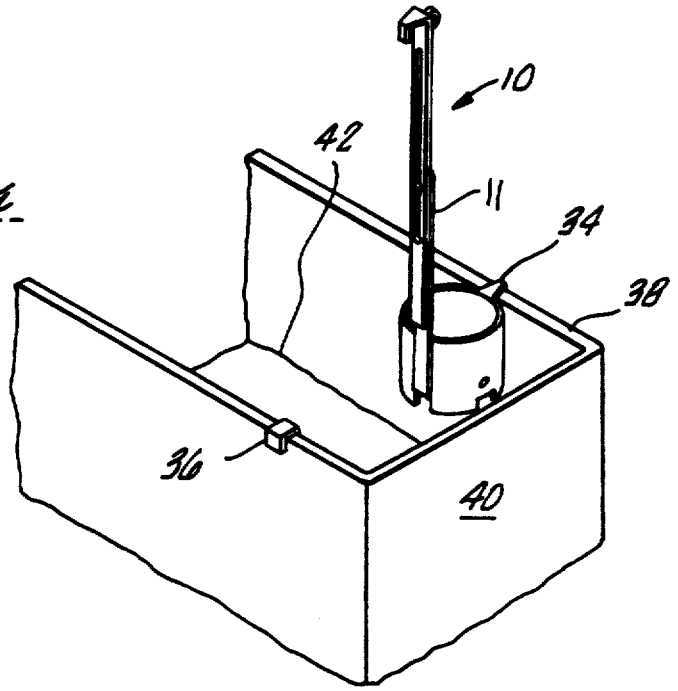
FIG. 4 is a perspective view of the hanger of FIG. 1 mounted on a toilet tank in a manner suitable for changing the chemical dispenser.

FIG. 4 shows the hanger 10 temporarily mounted from the exchange hook 34 on the tank edge 38. This is accomplished without soiling or wetting the users hands by placing a finger into the loop 26 and lifting the hanger 10 out of the tank water. This allows the depleted dispenser 30 to drain so the leftover chemical or dye solution does not stain the bathroom floor or the user's fingers. The drained dispenser 30 can then be removed, a full dispenser 30 placed in the holder 16, and the hanger 10 remounted on the tank wall through use of the hook 23 and loop 26.

Under normal operating conditions a toilet tank 40 is partially filled with water. The maximum water level 42 in the tank 40 is the level of water established when the valving mechanism cuts off inflow of water to the tank. Activating the flushing mechanism drains water from the tank 40 into the toilet bowl carrying with it additive from the dispenser 30.

Although the present invention has been described in considerable detail with reference to certain preferred versions, other versions are possible.

For example, the holder 16 can be of any cross-section such as round, square, rectangular, or triangular. The loop 26 can be a half circle, hook or a hole within the upper support 12. Alternatively, lifting means such as a hole and separate hook arrangement can be used. The hanger 10, which is preferably constructed of a plastic resistant to deterioration in water, can be fabricated from various materials or combination of materials such as polystyrene, polycarbonate, acrylics, polyethylene, polypropylene or other similar materials. In addition, brackets, caps or other retaining mechanism may be utilized to hold the dispensers in the holder 16.

One of the significant advantages of the hanger 10 is that it is a reusable holder for a disposable chemical dispenser already available on the market. The holder 10 makes it possible for the dispenser to be placed in a location within the toilet tank which avoids interference with the toilet operating mechanism while at the same time allowing the dispenser to operate more effectively.

An additional advantage is that the hanger allows replenishment of the chemical dispenser without wetting or soiling of the user's hands or the area surrounding the toilet.

Therefore, the spirit and scope should not be limited to the description of the preferred version contained herein.

I claim:

1. A hanger for a dispenser of an additive into water retained within the flush tank of a toilet, the hanger comprising:

(a) an elongated support having an upper portion and a lower portion;

(b) a dispenser holder on the lower portion of the support for removably supporting the dispenser;

(c) means on the upper portion of the support for suspending the support from the toilet tank such that the dispenser holder is below the maximum water level in the tank;

(d) attachment means on the lower portion of the hanger for supporting the dispenser on the upper portion of the tank with at least the upper portion of the dispenser above the maximum water level so that the dispenser can be removed from the hanger and a replacement dispenser placed into the hanger without wetting the user's hands, and (e) gripping means projecting outwardly from the upper portion of the support, the gripping means being positioned so that it is above the maximum water level in the tank when the hanger is suspended from the tank by the upper suspending means such that a user can lift the hanger and dispenser from the tank without getting wet, wherein the gripping means is a loop sized for removable insertion of a finger therein.

2. The hanger of claim 1 wherein the dispenser holder is a cylindrical cup.

3. The hanger of claim 2 wherein the cylindrical cup has at least one opening therein for providing distribution of additives from within the dispenser.

4. The hanger of claim 1 wherein the dispenser holder has openings therein to facilitate dispersion of the additives.

5. The hanger of claim 1 wherein the support comprises two portions axially movable relative to each other and means for adjusting the relative axial position of the two portions to vary the length of the hanger so that the dispenser holder is suspended above the toilet tank bottom when the support is suspended from the upper portion of the toilet tank.

6. A hanger for a dispenser of an additive into water retained within the flush tank of a toilet, the hanger comprising:

(a) an elongated support having an upper portion and a lower portion;

(b) a first means to vertically suspend the support from the toilet tank such that the upper portion of the support is above the maximum water level in the tank;

(c) a container mounted on the lower portion of the support for removably holding the dispenser such that the dispenser is below the maximum water level in the tank;

(d) an exchange hook on the container for supporting the hanger on the upper portion of the tank for replacement of the dispenser; and (e) gripping means projecting outwardly from the upper portion of the support above the maximum water level in the tank, the gripping means being positioned so that the hanger with dispenser therein can be lifted from the tank without wetting the user's hands.

7. A hanger for holding a chemical dispenser within a toilet tank, said hanger being elongated and having an outwardly extending support means integral with a lower portion of the hanger, said support means sized to stably mount the hanger on a top rim of the toilet tank during an exchange of the chemical dispenser, lifting means integral with an upper portion of the hanger and extending in the direction of said support means, said lifting means being a loop sized for insertion of a finger, and said lower portion of the hanger including means for removably holding the dispenser.

8. A method of changing a depleted chemical dispenser mounted within a hanging holder in a toilet tank, the holder being elongated and having upper and lower support means for selectively supporting the holder on an upper edge of the toilet tank, the lower support means extending outwardly from the holder, said method comprising the steps of:

(a) raising the holder such that the chemical dispenser is above the water level in the tank;
(b) mounting the holder by the lower support means on the upper edge of the toilet tank with the dispenser above the water in the tank;
(c) exchanging the depleted dispenser for a replacement dispenser; and
(d) remounting the holder by the upper support means on the upper edge of the toilet tank with the dispenser within the tank below the water level when the tank is full.

* * * * *